US005281174A

United States Patent [19]

Bonner

[11] Patent Number: 5,281,174

[45] Date of Patent: Jan. 25, 1994

[54] CORONA TREATER HIGH VOLTAGE PLUG-IN

[75] Inventor: William H. Bonner, Cedarburg, Wis.

[73] Assignee: Pillar Technologies, Hartland, Wis.

[21] Appl. No.: 974,909

[22] Filed: Nov. 12, 1992

[51] Int. Cl.[5] ..... H01R 15/08

[52] U.S. Cl. ..... 439/825; 174/35 C

[58] Field of Search ..... 439/577, 825, 826, 827; 101/153; 118/620, 621; 355/211, 221; 361/214; 174/35 C

[56] References Cited

U.S. PATENT DOCUMENTS

| | | | |
|---|---|---|---|
| 2,959,759 | 11/1960 | Nava | 439/827 X |
| 3,924,921 | 12/1975 | Feightner | 439/825 X |
| 4,281,247 | 7/1981 | Schuster | 101/153 X |
| 4,307,431 | 12/1981 | Sone et al. | 355/221 X |
| 4,344,700 | 8/1982 | Kasama et al. | 355/211 |

*Primary Examiner*—Peter Dungba Vo

*Attorney, Agent, or Firm*—Andrus, Sceales, Starke & Sawall

[57] ABSTRACT

A high voltage connector between the elongated electrode assembly of a corona treater and a high voltage source include a receptacle disposed at one end of the electrode assembly and having an insulated connector in contact with the electrode. The insulation extends out from the electrode assembly to define a cavity that accepts a plug-in that establishes electrical contact between the high voltage source and the electrode. The cavity has a cross-sectional area only slightly larger than a portion of the high voltage wire disposed within it.

5 Claims, 2 Drawing Sheets

CORONA TREATER HIGH VOLTAGE PLUG-IN

BACKGROUND OF THE INVENTION

The present invention relates to corona treaters and more specifically to the electrical connection between the electrode of the corona treater and a high voltage source. A corona treater utilizes an electrode magazine or cassette that must be periodically removed from the corona treater. In the past, the electrical connection between the high voltage source and the electrode magazine was a permanently soldered connection that made removal of the electrode magazine from its station a time consuming and somewhat difficult job.

The purpose of the present invention is to provide a simple high voltage plug-in connection between the electrode and the high voltage source so that the connection can be easily disconnected to facilitate the removal of the electrode magazine from its station.

SUMMARY OF THE INVENTION

A high voltage connector between the elongated electrode of a corona treater and a high voltage source includes a receptacle disposed at one end of the electrode magazine and having a first end disposed within the electrode magazine and a second end extending outwardly from the magazine.

In accordance with one aspect of the invention, the first end of the receptacle includes an outer non-conductive shell surrounding a conductive layer connected to the electrode.

In accordance with another aspect of the invention, the second end of the receptacle defines an insulated cavity communicating with the conducting layer and having an opening at its outer end.

In accordance with yet another aspect of the invention, the connector includes a plug-in releasably disposed within the receptacle and having a first conductive end disposed within the cavity and in electrical contact with the conducting layer.

In accordance with still another aspect of the invention, a second end of the plug-in comprises a terminal in contact with the high voltage source and an insulated high voltage wire is disposed between the first and second ends.

In accordance with yet another aspect of the invention, the insulated high voltage wire has a cross-sectional dimension substantially equal to that of the insulated cavity.

The present invention thus provides a quick plug-in connection between the electrode and a high voltage source. The connector is easily disconnected to facilitate removal and repair or replacement of the electrode.

BRIEF DESCRIPTION OF THE DRAWINGS

The drawings illustrate the best mode presently contemplated of carrying out the invention.

In the drawings:

FIG. 4 is a side cross-sectional view of the assembled electrode magazine and high voltage plug-in.

DETAILED DESCRIPTION OF THE PREFERRED EMBODIMENT

Figure 1:
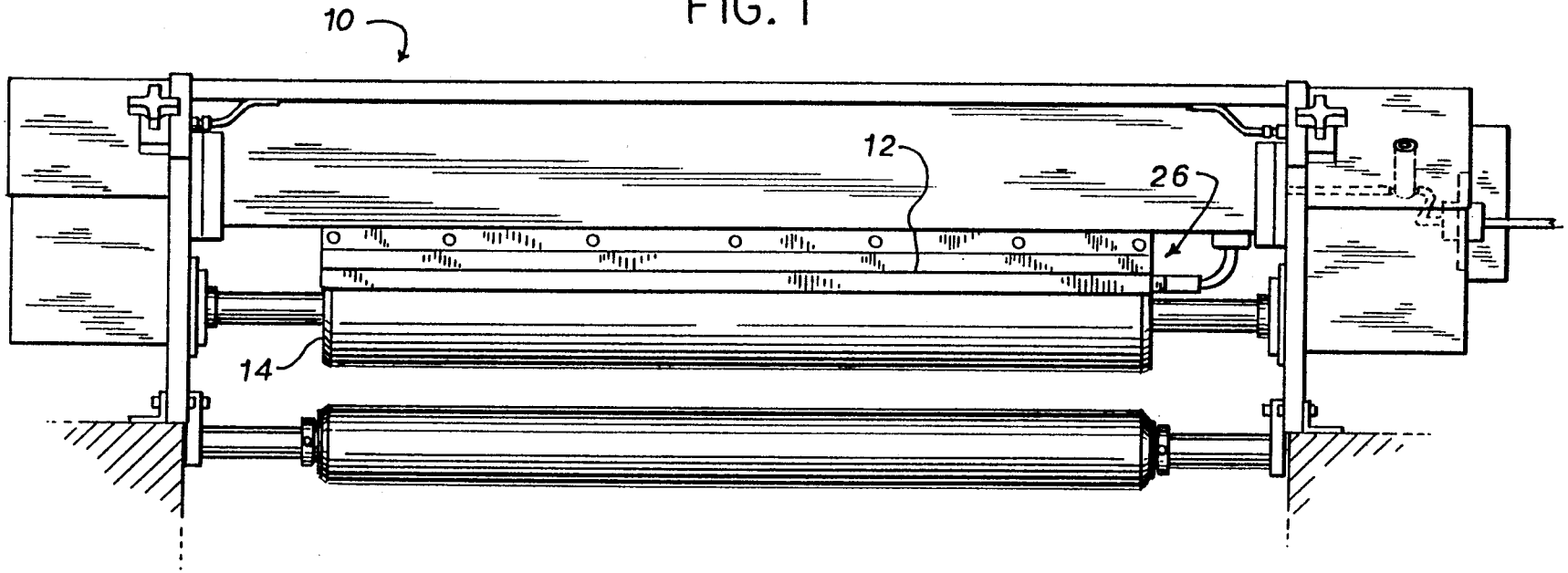
FIG. 1 is a front view of a corona treater constructed according to the present invention.
Figure 3:
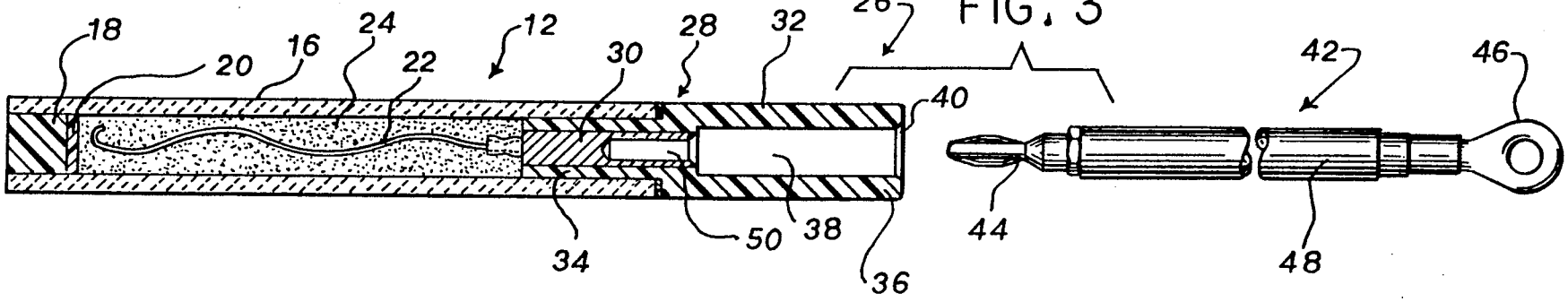
FIG. 3 is an exploded view of the electrode magazine and the high voltage plug-in with the electrode magazine shown in cross-section.
Figure 2:
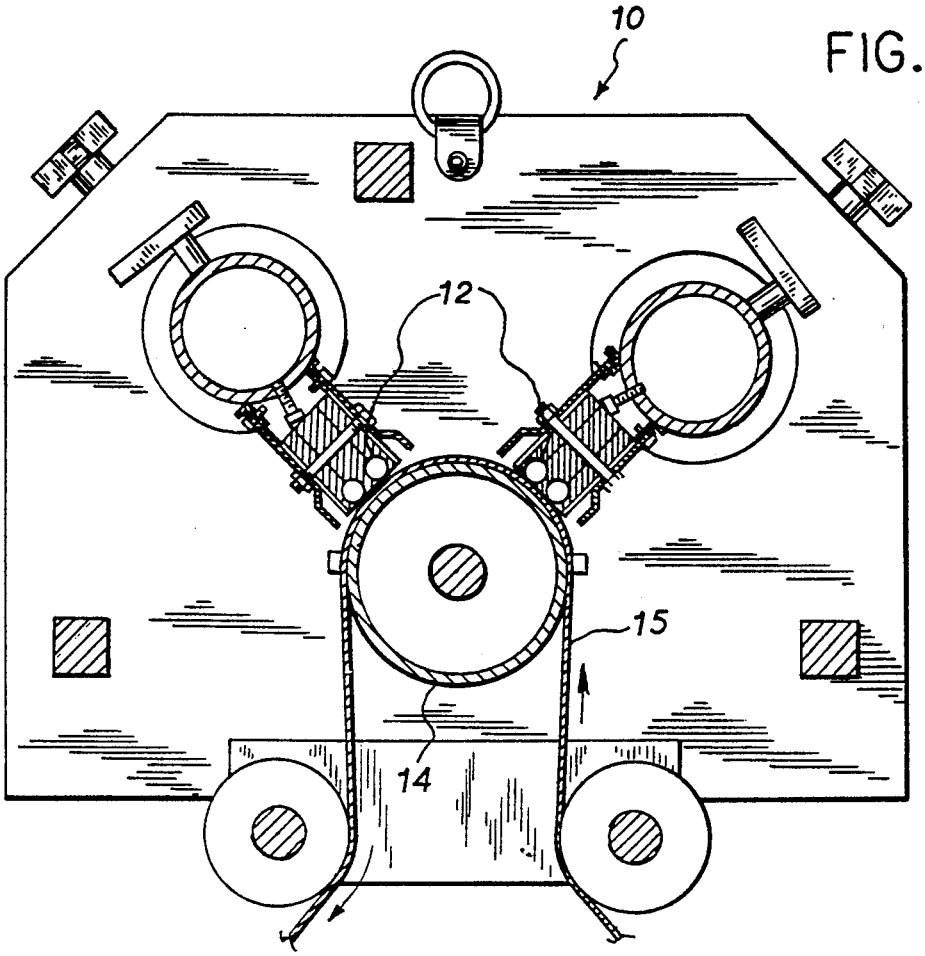
FIG. 2 is a side cross-sectional view of the corona treater shown in FIG. 1.

As shown in FIG. 1, a corona treater 10 includes an electrode magazine 12 positioned in close proximity to a roller 14 over which a web of material 15 passes during corona treatment.

Electrode magazine 12 includes a ceramic tube 16 having one end closed with a sealed cap 18 that has a silicone disc 20 disposed on its inner surface.

An electrode wire 22 is disposed within ceramic tube 16 which is filled with aluminum powder 24. Routine maintenance and repair of corona treater 10 necessitates the periodic removal of electrode magazine 12. The removal of electrode magazine 12 is facilitated by high voltage connector 26.

High voltage connector 26 includes a receptacle 28 having a metallic conductor 30 disposed within one end of an elongated fiberglass shell 32. Receptacle 28 has a first end 34 disposed within electrode magazine 16 to allow the electrical connection between conductor 30 and electrode 22. Receptacle 28 has a second end 36 that extends outwardly from electrode magazine 12 and defines an insulated cavity 38 that communicates with metallic conductor 30 and has an opening 40 at its outer end.

Connector 26 is further provided with a plug-in 42 that is releasably disposed within receptacle 28. Plug-in 42 includes a conducting first end in the form of a banana plug 44 and a second end in the form of a terminal 46 for connection to the high voltage source. An insulated high voltage wire 48 is disposed between the first and second ends and has a cross-sectional dimension substantially equal to that of cavity 38 to minimize the air path that an electrical arc could follow. A portion of high voltage wire 48 is disposed within elongated cavity 38. The linear dimension of cavity 38 prevents high voltage arcing from the electrical connection.

Figure 4:
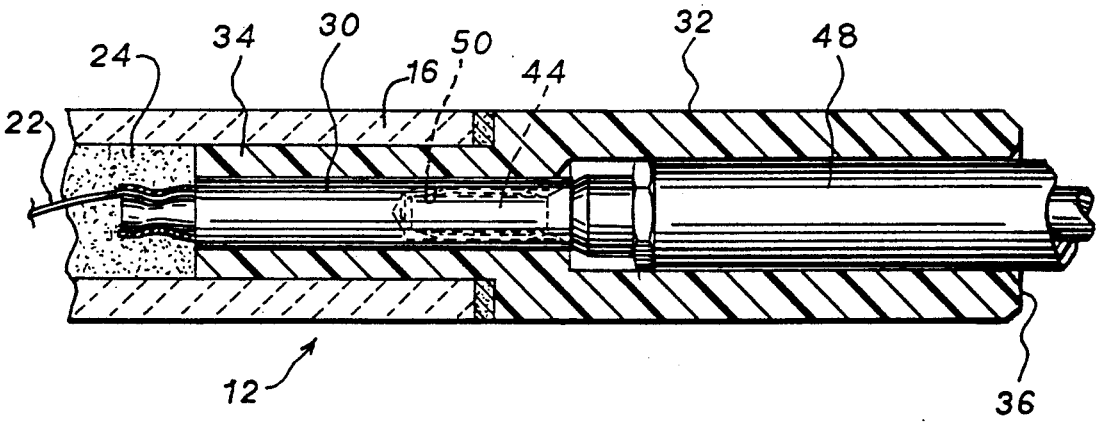

FIG. 4 shows electrical connector 26 in its connected state. In this state, banana plug 44 is received by cavity 50 in metallic conductor 30 and an electrical connection is formed. High voltage is thus allowed to pass from the source through terminal 46, through high voltage wire 48, through banana plug 44, through metallic conductor 30 and into electrode wire 22. When routine maintenance or repair requires the removal of electrode magazine 12, plug-in 42 is pulled from receptacle 28 to facilitate the removal of electrode magazine 12. The present invention thus provides a quick high voltage connection and disconnection that greatly facilitates the removal of electrode magazine 12.

Various modes of carrying out the invention are contemplated as being within the scope of the following claims particularly pointing out and distinctly claiming the subject matter regarded as the invention.

I claim:

1. A high voltage connector between an elongated electrode assembly of a corona treater and a high voltage source comprising:

an elongated receptacle disposed at one end of the electrode assembly, said receptacle having a first end disposed within the electrode with said first end having an outer non-conductive shell, said outer non-conductive shell surrounding an inner a conducting layer connected to the electrode, and a second end extending outwardly from the electrode assembly, said second end defining an elongated insulated cavity therein communicating with said conducting layer of said first end, said elongated cavity having an opening at its outer end, and a plug-in releasably disposed within said receptacle, said plug-in having a first conducting end disposed within said cavity of said second end of said receptacle and in electrical contact with said conducting layer of said first end, a second end in contact with the high voltage source and an elongated insulated high voltage wire disposed between said first and second ends of said plug-in, said insulated high voltage wire having a cross sectional dimension substantially equal to that of said elongated cavity of said second end of said receptacle to provide a frictional fit between said high voltage wire of said plug-in and said cavity of said second end of said receptacle.

2. The high voltage connector defined in claim 1 wherein a portion of said high voltage wire of said plug-in is disposed within said cavity of said second end of said receptacle.

3. The high voltage connector defined in claim 1 wherein said first end of said plug-in comprises a banana plug and said conducting layer of said first end of said receptacle includes a cavity for receiving said banana plug.

4. The high voltage connector defined in claim 1 wherein said insulated cavity of said second end of said receptacle has a cross-sectional dimension substantially equal to that of said high voltage wire.

5. The high voltage connector defined in claim 1 wherein said receptacle comprises a metal conductor disposed within a fiberglass shell with said shell extending linearly beyond said conductor to define said insulated cavity of said second end of said receptacle.

* * * * *